US005586720A

United States Patent [19]

Spiegel et al.

[11] Patent Number: 5,586,720

[45] Date of Patent: Dec. 24, 1996

[54] HOT WATER SUPPLY SYSTEM WITH A RING PIPELINE

[75] Inventors: Herbert Spiegel, Marktplatz 5, D-97464 Niederwerrn; Robert Böhm, Schonungen, both of Germany

[73] Assignee: Herbert Spiegel, Niederwerrn, Germany

[21] Appl. No.: 407,914

[22] Filed: Mar. 21, 1995

[30] Foreign Application Priority Data

Mar. 23, 1994 [DE] Germany ..... 44 09 927.4

[51] Int. Cl.[6] ..... F24D 3/02

[52] U.S. Cl. ..... 237/8 R; 137/339; 137/564; 237/63

[58] Field of Search ..... 237/8 R, 8 C, 237/59, 63; 137/337, 339, 564

[56] References Cited

U.S. PATENT DOCUMENTS

| | | | |
|---|---|---|---|
| 2,181,480 | 11/1939 | Gillett et al. | 237/8 C X |
| 2,262,194 | 11/1941 | Newton | 237/8 C X |
| 2,308,482 | 1/1943 | Adams, Jr. | 237/59 |
| 2,375,870 | 5/1945 | Ray | 237/8 |
| 3,897,903 | 8/1975 | Race | 237/8 R |
| 4,713,525 | 12/1987 | Eastep | 237/8 R X |
| 4,865,251 | 9/1989 | Briner | 237/8 R |
| 4,893,749 | 1/1990 | Schichi | 137/564 X |
| 5,277,219 | 1/1994 | Lund | 137/337 |

*Primary Examiner*—William E. Tapolcai
*Attorney, Agent, or Firm*—Edwin D. Schindler

[57] ABSTRACT

A hot water supply system is provided, which includes a ring pipeline which extends through a water heater and in which water circulates, before going through tap pipelines to taps. The circulation pipelines have a substantially smaller cross-section than that of the tap pipelines. The circulation pipelines extend, for a portion thereof, in the interior of the tap pipelines before terminating openly in a region of a tap. A pipe branch piece is included, which is in the form of a continuous pipe and forms a component of the tap pipeline. A branch pipe of the pipe branch piece receives the circulation pipeline. The branch pipe forms an acute angle with the tap pipeline, with the angle being opened opposite to the flow direction in the tap pipeline. The section of the circulation pipeline, which extends to the tap, is inserted endways into the branch pipe, while the remaining section of the branch pipe joints at the branch pipe and at the ring pipeline.

12 Claims, 2 Drawing Sheets

HOT WATER SUPPLY SYSTEM WITH A RING PIPELINE

BACKGROUND OF THE INVENTION

1. Technical Field of the Invention

The present invention relates to a hot water supply system having a water heater and a ring pipeline, which extends through the water heater and in which heated water circulates under either the influence of gravity or driven by a pump.

2. Description of the Prior Art

State-of-the-art central water heating devices have a ring pipeline through which the water circulates and to which the taps are connected. Such a device is disclosed in German Patent Application No. DE 36 20 551. In such devices, assurance is provided that even after an extended break in the extraction of hot water from the tap, hot water is immediately available at the tap when required.

A ring pipeline is, however, very costly to install, particularly as it concerns the need to retrofit existing systems. If hot water is to be immediately available at all taps, the ring pipeline is to be provided directly along the taps, with the result necessarily being that its length is extended and, thus, the associated heat loss and a corresponding high pumping procedure is required to maintain the circulation. The ring pipelines can hereby be of differing cross-sections (e.g., large cross-section in the flow, compared with a smaller cross-section in return.)

If taps are connected to a hot water supply system via tap pipelines, the water contained therein cools with time if none is extracted. To avoid this problem, it is known to the art to continuously circulate the water by means of a circulation pipeline of substantially smaller cross-section than the tap pipeline. This is provided in the interior of the tap pipeline and ends open in the region of the tap, so that the radiation losses are reduced, resulting in a simple and low-priced, new installation or retrofitting of an existing system. Such an apparatus is disclosed in German Patent Application No. DE 37 10 771.

In such a system, however, it is necessary, for example, in the region of the circulating pump, that a part of the circulation pipeline extends outside of the tap pipeline, thus, this part necessarily consists of a pressure-proof material in order to resist the operating pressure of the water supply system. In the case of retrofitting an existing system, the circulation pipeline is introduced into the tap pipeline via a T-piece and advanced as far as the tap. With this procedure, however, there is the disadvantage that the advancing device is only controlled with difficulty and the circulation pipeline, opposite the introductory opening, initially impinges the inside of the tap pipeline at, more or less, a right angle, so that it constantly buckles and is often damaged when being advanced to the tap.

Additionally, it is problematic to equip long tap pipelines with such a circulation pipeline since, owing to the small cross-section with increasing pipeline length, a rapidly increasing feed pressure is required to sustain the circulation. Therefore, circulation pipelines are used in the interior of the tap pipeline, generally in combination with a local hot water generator which, when compared with a central water heater, is substantially less efficient as measured by effectiveness and operating costs.

SUMMARY OF THE INVENTION

It is, therefore, an object of the present invention to provide a hot water supply system, to which taps are connected via tap pipelines to a central hot water supply having a ring pipeline, the ring pipeline having as short a length as possible, while all taps are capable of providing water of the desired temperature at all times.

The foregoing and related objects are achieved by the presently claimed invention, wherein a tap pipeline is provided with a circulation pipeline of substantially smaller cross-section than that of the tap pipeline. A section of the circulation pipeline extends outward from an interior portion of the tap pipeline, and ends in an open mode in the region of the tap. The portion of the circulation pipeline which extends outside of the tap pipeline includes a pressure-proof material and a pipe branch having a through pipe as a component of the tap pipeline, and which pipe branch receives the circulation pipeline. The longitudinal axis of the pipe branch forms an acute angle with the longitudinal axis of the tap pipeline; the angle being open opposite to the flow direction in the tap pipeline. The section of the circulation pipeline, which extends to the tap, is inserted endways in the branch pipe and the ends of the remaining section of the circulation pipeline join at the branch pipe and, via a further pipe branch, openly at the ring pipeline.

With the hot water supply, according to the present invention, outgoing water from a heat is fed through a ring pipeline to the region of the consumer. The length of the ring pipeline is, however, limited, in that the individual taps, for example, in a multi-story building, are connected to the ring pipelines via tap pipelines. The short length of the ring pipeline consequently has only limited heat loss, while its installation is possible at a low cost and the performance of the circulating pump required for its operation is limited.

In order to constantly provide hot water at the various taps, the interior portions of the tap pipelines are provided with a circulation pipeline, which ends open proximate to the tap inside of the pipeline. The other end of the circulation pipeline joins openly at the ring pipeline. With sufficient distance of this junction from the branching of the tap pipeline, convection is effected through the tap and circulation pipeline. The convection is driven by the temperature dependency of the water density of the flow in the ring pipeline and conveys hot water to the region of the tap. For this to occur, it is necessary for the circulation pipeline to extend partially outside of the tap pipeline, whereby the leadthrough of the circulation pipeline through the wall of the tap pipeline is effected in a pipe branch piece, the continuous pipe of which is a component of the tap pipeline.

The section of the circulation pipeline which extends to the tap is inserted endways into the branching pipe; the remaining section of the circulation pipeline, which returns to the ring pipeline, is affixed endways at the branch pipe. The longitudinal axis of the branch pipe forms an acute angle with the longitudinal axis of the tap pipeline, which preferably lies under 90° and opposite the flow direction, is opened in the tap pipeline. In this manner, the circulation pipeline is prevented from excessive bending in the tap pipeline and, particularly in the case of retrofitting, can be introduced into the tap pipeline without concern that it may be damaged.

DETAILED DESCRIPTION OF PREFERRED EMBODIMENTS

Figure 1:
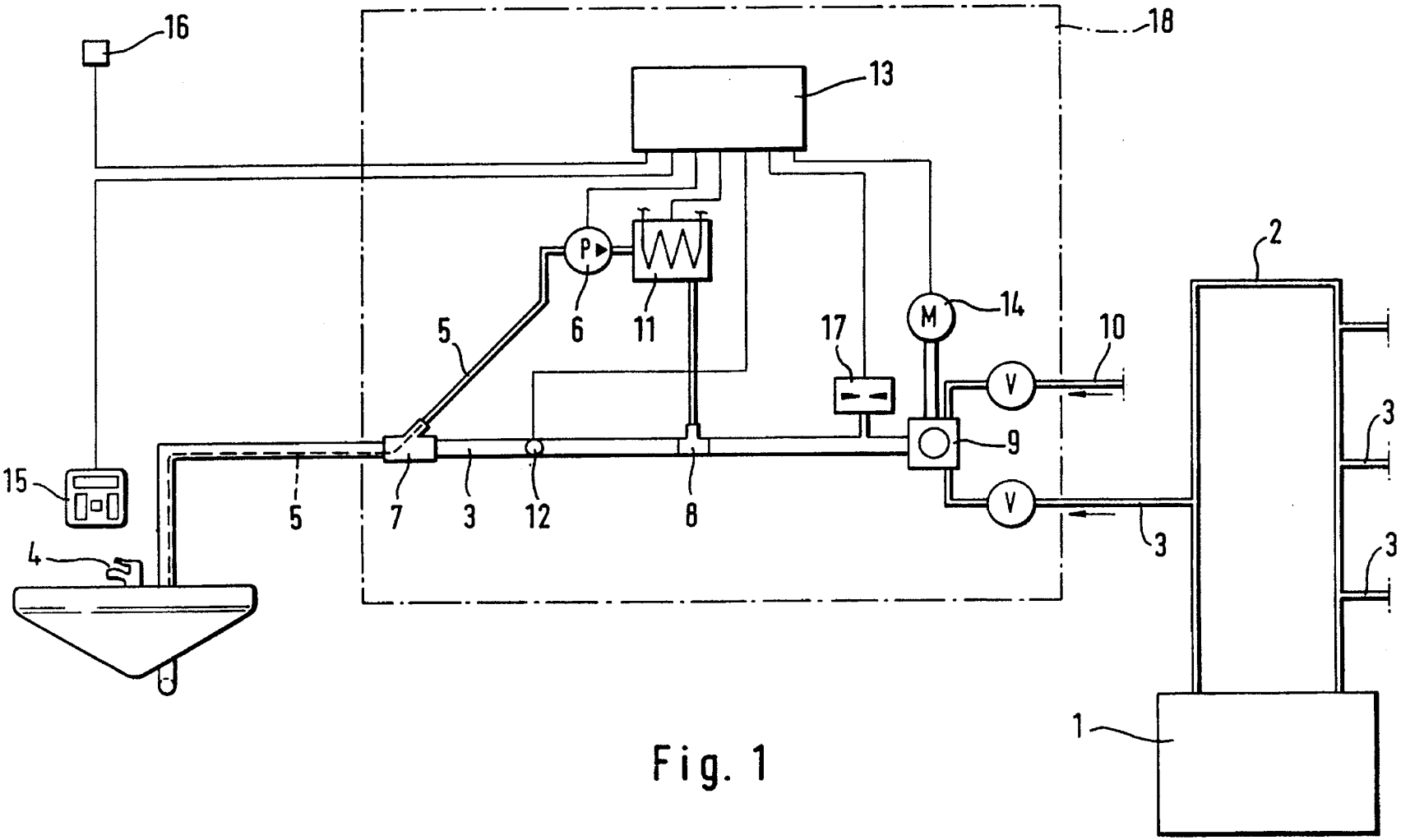

In a particularly advantageous manner, the hot water supply system of the present invention constantly provides hot water at the taps. The hot water is generated in a central water heater with a ring pipeline and is correspondingly favorable with respect to efficiency and price. Through the use of tap pipelines, the need for an unduly lengthy ring pipeline is avoided, as are the unnecessary energy losses, owing to heat radiation and flow resistances, as well as installation costs. The circulation pipeline, which extends inside of the tap pipeline, substantially reduces the amount of heat loss. Additionally, in this manner, it is possible to retrofit existing systems at a low cost. This advantage is enhanced via the special design of the pipe branch piece, which prevents the circulation pipeline from bending when it is inserted into an existing tap pipeline.

In a further advantageous embodiment of the present invention, sections of the circulation pipeline, which extend inside of the tap pipeline, comprise a flexible material. In this embodiment, the circulation pipeline can also be installed, trouble-free, in those regions of the tap pipeline which is non-linear; both in the case of new installations, as well as instances of retrofitting existing hot water supply systems. Additional, the use of a flexible material facilitates the introduction into the pipe branch piece.

If the supply system is intended to supply water of drinkable quality, the flexible of the circulation pipeline must be foodstuff-proof.

In a preferred embodiment, the circulation pipeline is affixed to the interior surface of the tap pipeline. This achieves a reliable and favorable flow guidance of the circulation pipeline. Preferably, affixation is continuous, as individual fastenings, disposed at a distance to one another, can cause a turbulence of the water in the tap pipeline, which increases flow resistance. With respect to manufacturing concerns, affixation via a stay is favorable.

The hot water provided by a central supply system is usually used to heat mixed water with different final temperatures. While high water temperatures are required at individual taps, in other regions, e.g., in the bathroom of a household, it is not necessary to provide hot water substantially above body temperature. The operation of greater parts of the water supply system, with lower operating temperatures, reduces heat losses and permits a lower cost for pipeline installation. Therefore, it is within the scope of the present invention to provide tap pipelines connected to a mixing device which, for its part, is fed from the hot water ring pipeline and a cold water pipeline.

With the use of a mixing device, a heating device with temperature sensor and control is suitable for the circulation pipeline, e.g., a flow heater of low performance. The circulation pipeline does not end directly in the ring pipeline, but proximate to the mixing device in the tap pipeline. In this manner, the energy loss is minimized in that comparatively cold mix water is returned to the ring pipeline and replaced by hot water that is immediately mingled with cold water in the mixing device. Furthermore, an exact regulation of the mixing temperature of the low circulation quantity is technically difficult and more easily realizable through additional heating means with low performance.

In addition to the foregoing, it is proposed by the present invention to provide the circulation pipeline with a circulating pump, whereby both circulatory directions are possible. A pump also creates a circulation, if this is not otherwise possible under the influence of gravity, e.g., if the circulation and the tap pipeline are executed in the same plane, or if circulation is opposed by a high flow resistance, e.g., if it is effected across a mixing device.

During extraction of water from a tap, it is not necessary for the water to be circulated through the circulation pipeline; depending upon the circulatory direction, the extraction process can even be hindered. Therefore, in an embodiment of the present invention, the circulating pump has a control unit that interrupts the pump process during a water extraction. Since a water extraction involves a fall in pressure in the tap pipeline, this can be determined by a pressure sensor so situated.

A suitable hot water supply system is equipped with a central control unit for a circulating pump, heating and/or mixing device, and is connected to the appropriate sensors. A central control unit further allows for an automatic operation of the system, as well as for additional protective measures, e.g., switching off of the heating unit in the event of a failure of the circulating pump. With the aid of a timer clock, a lowering of the temperature during an overnight period, or an occasional increase in the heating temperature of the mix water to kill germs, is possible.

In connection with a central control unit, a motion detector allows the water in the tap to be raised only to the operating temperature when a person is in its proximity and, thus, allows for energy savings, especially at seldom-used taps. Through an entry device in the region of a tap, comfortable operation of the control unit is realized.

BRIEF DESCRIPTION OF THE DRAWING FIGURES

Figure 2:
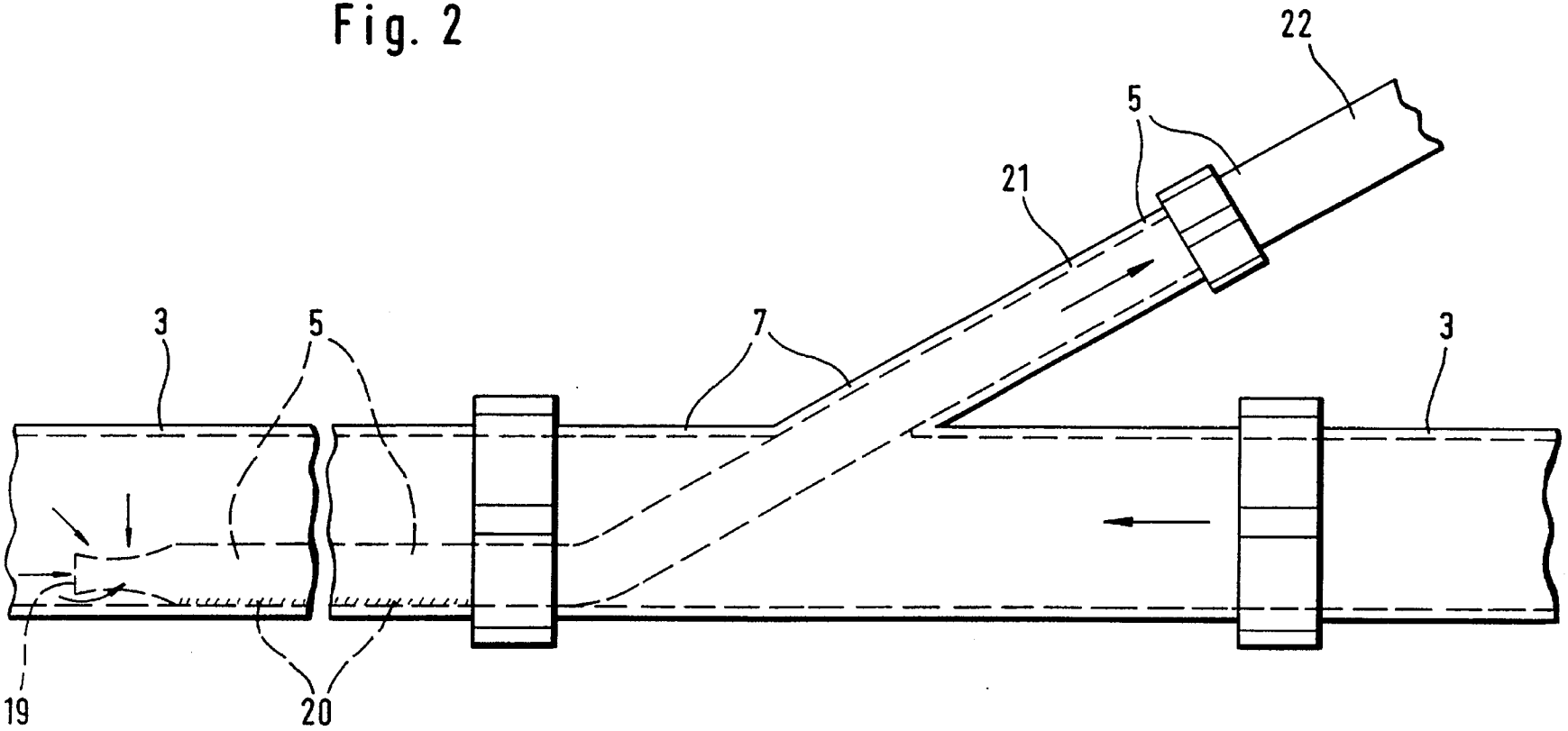

In the drawing, wherein similar reference numerals denote similar features throughout the several views, the drawing shows in schematic diagram in:

FIG. 1 a hot water supply system according to the invention; and,

FIG. 2 pipe branch piece according to the invention.

DETAILED DESCRIPTION OF THE DRAWING FIGURES

FIG. 1 is a schematic diagram of a hot water supply system according to the present invention. As detailed in FIG. 1, water is heated in a heater (1) and circulated, preferably being driven by a pump, through a ring pipeline (2). Via tap pipelines (3) (for reasons of clarify, only one is completely drawn), from which the heated water reaches the taps (4). In order that hot water is immediately available at the taps (4), when no extraction therefrom has taken place for an extended period of time, tap pipelines (3) are provided with a circulation pipeline (5), through which the cooled water is removed From the region of taps (4) and is conveyed into the warmer part of tap pipeline (3), which is located proximate to ring pipeline (2), with the aid of a circulating pump (6). Circulation pipeline (5), which is open endways in the region of tap (4), is executed partly inside tap pipeline (3) in order to reduce heat loss and the installation cost. Proximate to circulating pump (6), it is led through a pipe branch piece (7) out of tap pipeline (3) and terminates after passing circulating pump (6) via T-piece (8), which is preferably disposed proximate to the branching of ring pipeline (2), in tap pipeline (3).

A further energy savings can be achieved in the operation of the hot water supply system wherein the tap pipelines, which are connected to taps, and for which only moderately hot water is required, are connected to ring pipeline (2) via a mixing device (9), so that the water of the ring pipeline is mixed with water from a cold water pipeline (10) and, thus, is brought to the required temperature. Since it would be unsuitable to return the cooler mix water through the circulation pipeline (5) into the ring pipeline (2) and to simultaneously cool hot water through a mingling process, temperature is regulated by heating means (11), which is disposed in circulation pipeline (5). A temperature sensor (12) within tap pipeline (3), in collaboration with a central control unit, serves to regulate the temperature of heater (11) and of the mixing device (9) via a servomotor (14). Preferred is the disposal of an entry device (15) of control unit (13) in the region of a tap (4). In the case of taps used only occasionally, a motion detector (16) is suitable in order that the control unit can determine the presence of persons and, only in the case of such presence, raises the water at tap (4) to an operating temperature via heating means (11) or mixing device (9).

Finally, a pressure sensor (17) is disposed in tap pipeline (3) with which the pressure drop associated with a water extraction is determinable, so that the circulating pump (6) and also the heating means (11) is switched off during water extraction via the control unit (13). To facilitate installation of the system, it is advantageous to integrate the components in the region (18) delimited by the dotted line in a common housing.

Pipe branch piece (7) and the end of circulation pipeline (5), in the region of tap (4), are represented in FIG. 2 at a greater scale. The water flows out of the tap pipeline (5) into open end (19) of circulation pipeline (5). The affixing of circulation pipeline (5) inside of tap pipeline (3) is effected by means of a continuous stay (20). In pipe branch piece (7), circulation pipeline (5) enters branch pipe (21) at an acute angle so that it is not bent too greatly. To resist the operating pressure of the system, the circulation pipeline is executed in its further extension as a pressure-proof pipe (22).

We claim:

1. A hot water supply system, comprising:

a water heater;

a circulation pipeline;

at least one tap pipeline leading to a tap, said tap pipeline having therein said circulation pipeline of a smaller cross-section than said tap pipeline, with a section of said circulation pipeline extending from an interior portion of said tap pipeline and outwardly from said tap pipeline and terminating opening in proximity to said tap, said circulation pipeline being comprised of a pressure-proof material for that portion extending outwardly from said tap pipeline;

a first pipe branch piece made of continuous pipe, said first pipe branch piece being a component of said tap pipeline and having a branch pipe which receives said circulation pipeline, with a longitudinal axis of said branch pipe forming an acute angle with a longitudinal axis of said tap pipeline, the acute angle formed being open opposite a direction of flow in said tap pipeline with the section of said circulation pipeline extending to said tap being inserted endways into said branch pipe;

a second pipe branch piece; and, a ring pipeline extending through said water heater in which heated water circulates in said ring pipeline before proceeding therefrom to at least one of said tap pipelines then to said tap, with ends of a remaining section of said circulation pipe joining at said branch pipe and, via said second pipe branch piece, open at said ring pipeline.

2. The hot water supply system according to claim 1, wherein said section of said circulation pipeline extending into the interior portion of said tap pipeline comprises a flexible material.

3. The hot water supply system according to claim 1, herein said circulation pipeline is made of a foodstuff-proof material.

4. The hot water supply system according to claim 1, wherein said section of said circulation pipeline extending into the interior portion of said tap pipeline is affixed to an interior surface of said tap pipeline.

5. The hot water supply system according to claim 4, wherein said circulation pipeline is continuously affixed to the interior surface of said tap pipeline.

6. The hot water supply system according to claim 4, wherein said circulation pipeline is affixed to the interior surface of said tap pipeline via a stay.

7. The hot water supply system according to claim 1, further comprising a mixing device and a cold water pipeline, with said tap pipeline being connected to said mixing device, said mixing device being fed out of said ring pipeline and said cold water pipeline.

8. The hot water supply system according to claim 1, further comprising a circulating pump for said circulation pipeline.

9. The hot water supply system according to claim 8, wherein said circulating pump includes a control unit having a pressure sensor disposed in said tap pipeline, said control unit having means for starting a pumping procedure of said circulating pump in the event of an increase in pressure and means for interrupting the pumping procedure in the event of a decrease in pressure.

10. The hot water supply system according to claim 8, further comprising a central control unit having sensor means for controlling said circulating pump, heating means or said mixing device.

11. The hot water supply system according to claim 10, further comprising a motion detector being connected to said central control unit.

12. The hot water supply system according to claim 10, wherein said central control unit includes an entry device in proximity to said tap.

* * * * *